US009728370B2

(12) United States Patent
Moore et al.

(10) Patent No.: US 9,728,370 B2
(45) Date of Patent: Aug. 8, 2017

(54) FOCUSING STRUCTURES WITH NON-RECTILINEAR FOCUSING APERTURES

(71) Applicant: VAREX IMAGING CORPORATION, Salt Lake City, UT (US)

(72) Inventors: Paul D. Moore, Salt Lake City, UT (US); Kasey Otho Greenland, West Jordan, UT (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 154 days.

(21) Appl. No.: 14/610,981

(22) Filed: Jan. 30, 2015

(65) Prior Publication Data

US 2016/0225573 A1 Aug. 4, 2016

(51) Int. Cl.

| | |
|---|---|
| ***H01J 35/14*** | (2006.01) |
| ***H01J 35/06*** | (2006.01) |
| ***H01J 3/14*** | (2006.01) |
| *H01J 35/26* | (2006.01) |

(52) U.S. Cl.

CPC ..... *H01J 35/14* (2013.01); *H01J 3/14* (2013.01); *H01J 35/06* (2013.01); *H01J 35/26* (2013.01)

(58) Field of Classification Search

CPC .. H01J 35/00; H01J 35/02; H01J 35/04; H01J 35/06; H01J 35/065; H01J 35/08; H01J 35/14; H01J 29/586; H01J 35/26; H01J 29/58; G01N 23/04

See application file for complete search history.

(56) References Cited

U.S. PATENT DOCUMENTS

| | | | | |
|---|---|---|---|---|
| 5,623,530 | A * | 4/1997 | Lu | H01J 35/06 378/136 |
| 6,313,574 | B1 * | 11/2001 | Banno | H01J 29/076 313/402 |
| 6,333,969 | B1 * | 12/2001 | Kujirai | H01J 35/06 313/421 |
| 7,327,829 | B2 * | 2/2008 | Chidester | H01J 35/06 378/136 |
| 2004/0081282 | A1 * | 4/2004 | Schaefer | H01J 35/06 378/136 |
| 2004/0202282 | A1 * | 10/2004 | Miller | H01J 35/16 378/140 |
| 2006/0233308 | A1 * | 10/2006 | Nonoguchi | G21K 1/06 378/136 |
| 2014/0254767 | A1 * | 9/2014 | Boye | H01J 35/14 378/136 |

* cited by examiner

*Primary Examiner* — David E Smith
(74) *Attorney, Agent, or Firm* — Maschoff Brennan

(57) ABSTRACT

An example embodiment includes a cathode assembly. The cathode assembly includes a cathode head, a filament, a focusing structure, and a non-rectilinear focusing aperture. The cathode head defines a filament slot. The filament is positioned in the filament slot that is capable of emitting electrons by thermionic emission. The focusing structure is positioned at least partially between the filament and an anode. The non-rectilinear focusing aperture is defined in the focusing structure. The non-rectilinear focusing aperture is configured to shape an emission profile of electrons emitted by the filament.

19 Claims, 10 Drawing Sheets

FOCUSING STRUCTURES WITH NON-RECTILINEAR FOCUSING APERTURES

FIELD

The embodiments described herein relate to x-ray tubes. In particular, some embodiments described herein relate to non-rectilinear focusing structures.

RELEVANT TECHNOLOGY

X-ray tubes are used in a variety of industrial and medical applications. For example, x-ray tubes are employed in medical diagnostic examination, therapeutic radiology, semiconductor fabrication, and material analysis. Regardless of the application, most x-ray tubes operate in a similar fashion. X-rays, which are high frequency electromagnetic radiation, are produced in x-ray tubes by applying an electrical current to a cathode to cause electrons to be emitted from the cathode by thermionic emission. The electrons accelerate towards and then impinge upon an anode. When the electrons impinge upon the anode, the electrons can collide with the anode to produce x-rays. The area on the anode in which the electrons collide is generally known as a focal spot.

The subject matter claimed herein is not limited to embodiments that solve any disadvantages or that operate only in environments such as those described above. Rather, this background is only provided to illustrate one exemplary technology area where some embodiments described herein may be practiced.

SUMMARY OF SOME EXAMPLE EMBODIMENTS

This summary is provided to introduce a selection of concepts in a simplified form that are further described below. This summary is not intended to identify key features of the claimed subject matter, nor is it intended to be used as an aid in determining the scope of the claimed subject matter.

An example embodiment includes a cathode assembly. The cathode assembly includes a cathode head, a filament, a focusing structure, and a non-rectilinear focusing aperture. The cathode head defines a filament slot. The filament is positioned in the filament slot that is capable of emitting electrons by thermionic emission. The focusing structure is positioned at least partially between the filament and an anode assembly. The non-rectilinear focusing aperture is defined in the focusing structure. The non-rectilinear focusing aperture is configured to shape an emission profile of electrons emitted by the filament.

Another example embodiment includes a focusing structure. The focusing structure is configured to compensate for a lack of rectilinear conformity of a focal spot produced on an anode by emission of electrons by a filament. The focusing structure includes a surface and a non-rectilinear focusing aperture. The non-rectilinear focusing aperture is defined in the surface. The non-rectilinear focusing aperture includes two linear edges configured to be oriented substantially perpendicular to a longitudinal dimension of the filament and two curved edges configured to be oriented along the longitudinal dimension of the filament.

Another example embodiment includes an x-ray tube. The x-ray tube includes a cathode head, a filament, an anode, a focusing structure, and a non-rectilinear focusing aperture.

The cathode head includes a filament slot defined therein in a first direction. The filament that is capable of emitting electrons is positioned within the filament slot such that a longitudinal dimension of the filament is oriented parallel to the first direction. The anode includes a target surface on which a focal spot is produced due to impingement of electrons emitted from a filament. The focusing structure is positioned at least partially between the filament and the anode. The focusing structure is configured to shape an emission profile of electrons emitted by the filament. The non-rectilinear focusing aperture is defined in the focusing structure. The non-rectilinear focusing aperture includes at least one curved edge.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

A more particular description of the invention will be rendered by reference to specific embodiments thereof which are illustrated in the appended drawings. It is appreciated that these drawings depict only example embodiments of the invention and are therefore not to be considered limiting of its scope. These example embodiments will be described and explained with additional specificity and detail through the use of the accompanying drawings in which.

DESCRIPTION OF SOME EXAMPLE EMBODIMENTS

Reference will now be made to figures wherein like structures will be provided with like reference designations. It is understood that the drawings are diagrammatic and schematic representations of exemplary embodiments, and are not necessarily limiting to embodiments described herein nor are they necessarily drawn to scale.

In x-ray tubes, x-rays are generated when the electrons, which have been thermionically emitted from a filament of a cathode assembly, impinge upon an anode. Collisions of the electrons with the anode produce x-rays that may exit the x-ray tube and may be implemented in some application. The area on the anode in which the electrons collide is generally known as a focal spot. The cathode assembly can include a focusing structure. The focusing structure can shape an emission profile of the electrons as the electrons are emitted from the filament. Accordingly, geometry of the focal spot is determined at least partially by geometry of the focusing structure.

In some x-ray tubes, a desirable focal spot is substantially rectilinear. Additionally, it may be desirable to reduce the size of the focal spot. However, in cathode assemblies in which the focusing structure is substantially rectilinear, the focal spot may include a non-rectilinear shape. For example, the focal spots may include focal spot protrusions (hereinafter "spot protrusions") that extend from a central portion of the focal spot, may include an hourglass shape, or may include an oval shape. FIGS. 1A-1D illustrate some example non-rectilinear focal spots 100A-100E (collectively, focal spots 100). The focal spots 100 are depicted in FIGS. 1A-1D as they may appear on an anode 102 (labeled in FIGS. 1A and 1C only). The focal spots 100 are generally representative of where electrons are impinging upon the anode. Each of the focal spots 100 are also depicted with a dashed box 104 representing a rectilinear spot approximation fit to an outermost dimension of the focal spots 100. Differences between the focal spots 100 and the dashed box 104 illustrate the lack of rectilinear conformity of the focal spots 100.

Figure 1B:
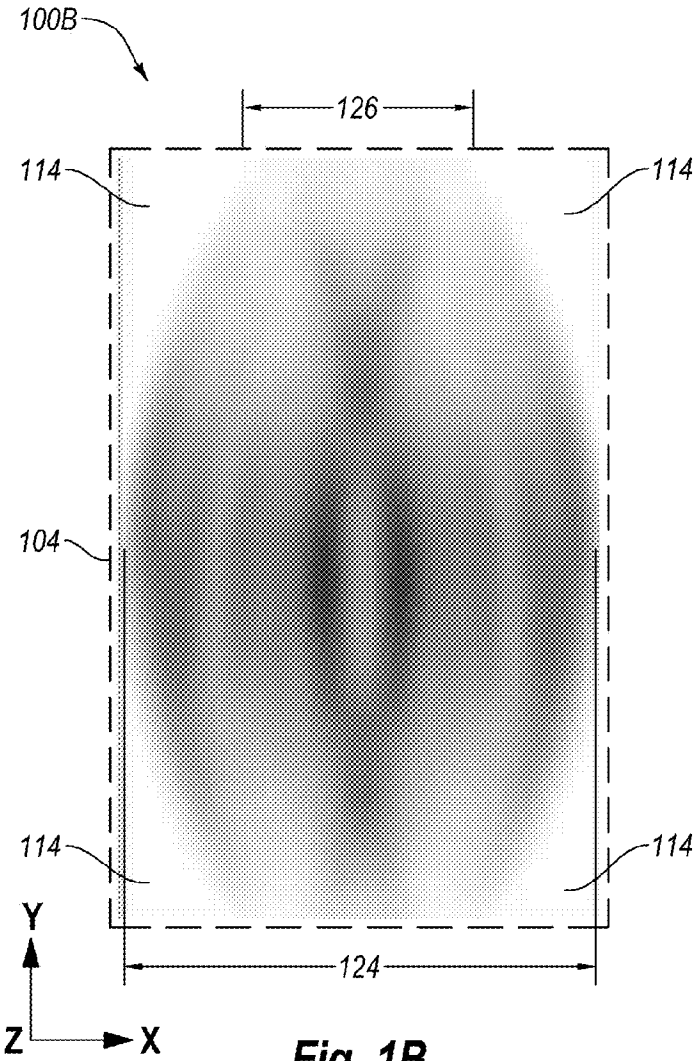
FIG. 1B illustrates another example non-rectilinear focal spot.
Figure 1A:
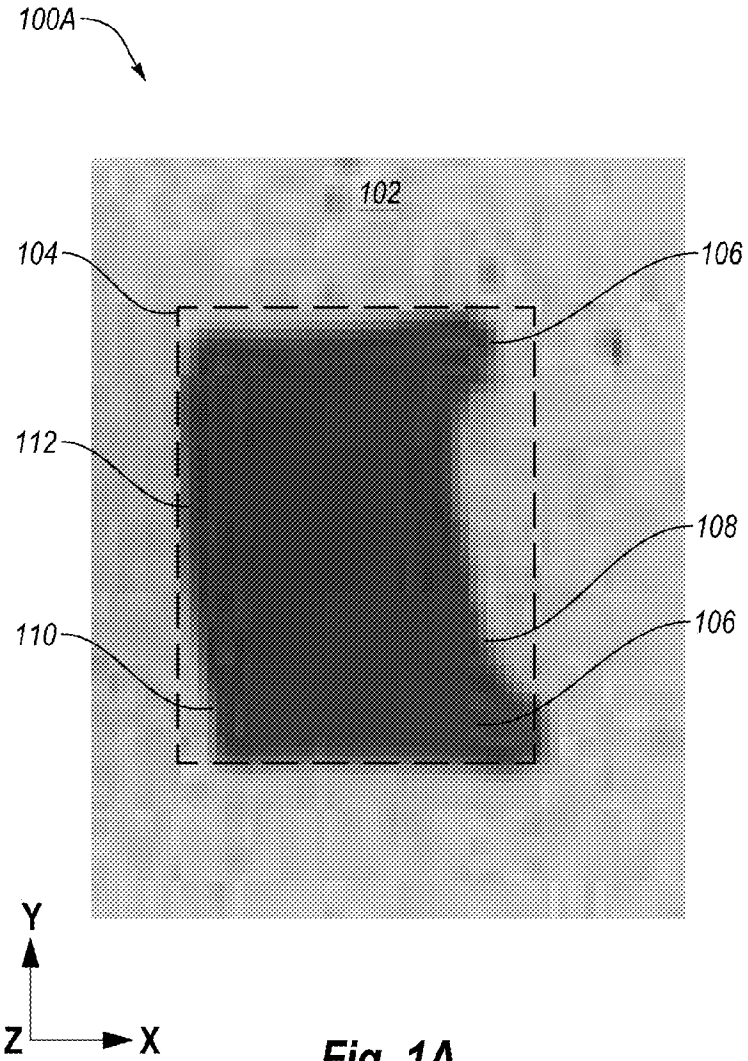
FIG. 1A illustrates an example non-rectilinear focal spot.

With reference to FIG. 1A, a first focal spot 100A may result from a cathode assembly implementing a focusing structure defining a substantially rectilinear focusing aperture. The first focal spot 100A includes features that are referred to herein as spot protrusions 106. The spot protrusions 106 appear on a first side 108 of the first focal spot 100A and generally extend in a positive x-direction. Additionally, the first focal spot 100A includes an overall arced contour 110. The arced contour 110 includes a curved shape that appears on a second side 112 and permeates throughout the first focal spot 100A.

With reference to FIG. 1B, a second focal spot 100B may result from a cathode assembly implementing focusing structure referred to as a focusing cup. The focusing cup may define a focusing aperture that is substantially rectilinear. The second focal spot 100B includes rounded corners 114. The rounded corners 114 may result from the 3-D effects that cause electrons emitted from a middle portion of a filament to be focused differently than electrons emitted from end portions of the filament.

Figure 1C:
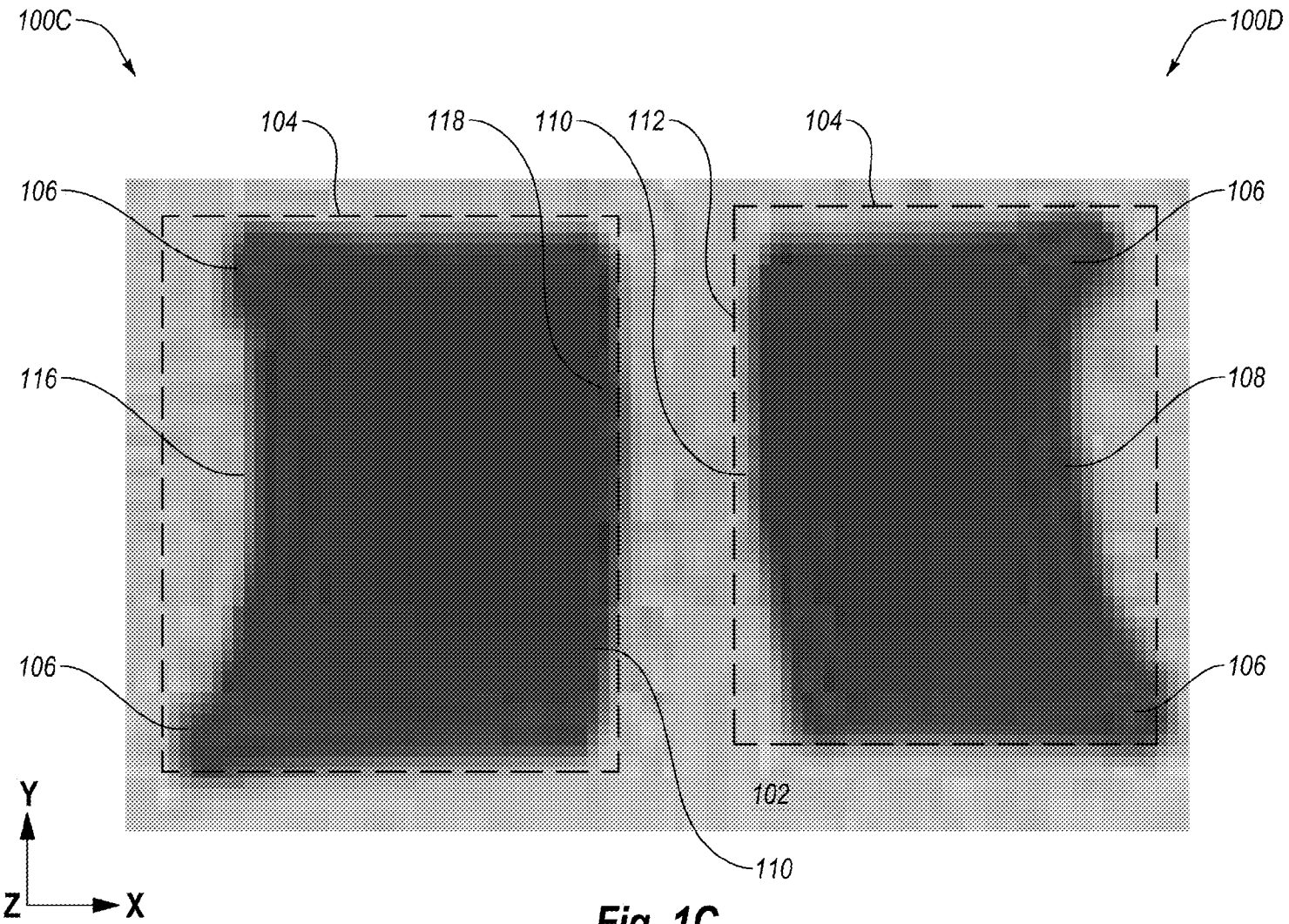
FIG. 1C illustrates another example non-rectilinear focal spot.

With reference to FIG. 1C, a third focal spot 100C and a fourth focal spot 100D may result from a cathode assembly implementing a focusing structure that defines two substantially rectilinear focusing apertures. The third focal spot 100C and the fourth focal spot 100D are depicted separated in the x-direction and as being generated concurrently. However, while operating, one of the third focal spot 100C or the fourth focal spot 100D is generated at any time and the third focal spot 100C may be formed on a portion of the anode 102 that substantially overlaps with a portion of the anode 102 on which the fourth focal spot 100D is formed.

The fourth focal spot 100D is similar to the first focal spot 100A of FIG. 1A. The third focal spot 100C is a mirror (e.g., symmetric about a line parallel to the y-axis) of the fourth focal spot 100D, for example, the spot protrusions 106 that appear on the first side 108 of the fourth focal spot 100D. Additionally, the fourth focal spot 100D includes the arced contour 110 that includes a generally arced shape on the second side 112 of the fourth focal spot 100D and permeates throughout the fourth focal spot 100D.

Similarly, the third focal spot 100C includes the spot protrusions 106 on a first side 116 of the third focal spot 100C. Additionally, the third focal spot 100C includes the arced contour 110 that includes a generally arced shape on a second side 118 of the third focal spot 100C and permeates throughout the third focal spot 100C.

The third focal spot 100C and the fourth focal spot 100D depict how the misshapen curvature of the focal spots 100C and 100D is related to a focusing geometry. For example, the third focal spot 100C and the fourth focal spot 100D are generated from a cathode assembly including mirror image areas of the cathode assembly. Accordingly, the third focal spot 100C and the fourth focal spot 100D are a mirror image, misshapen curvature that depart from the rectilinear spot approximation 104.

Figure 1D:
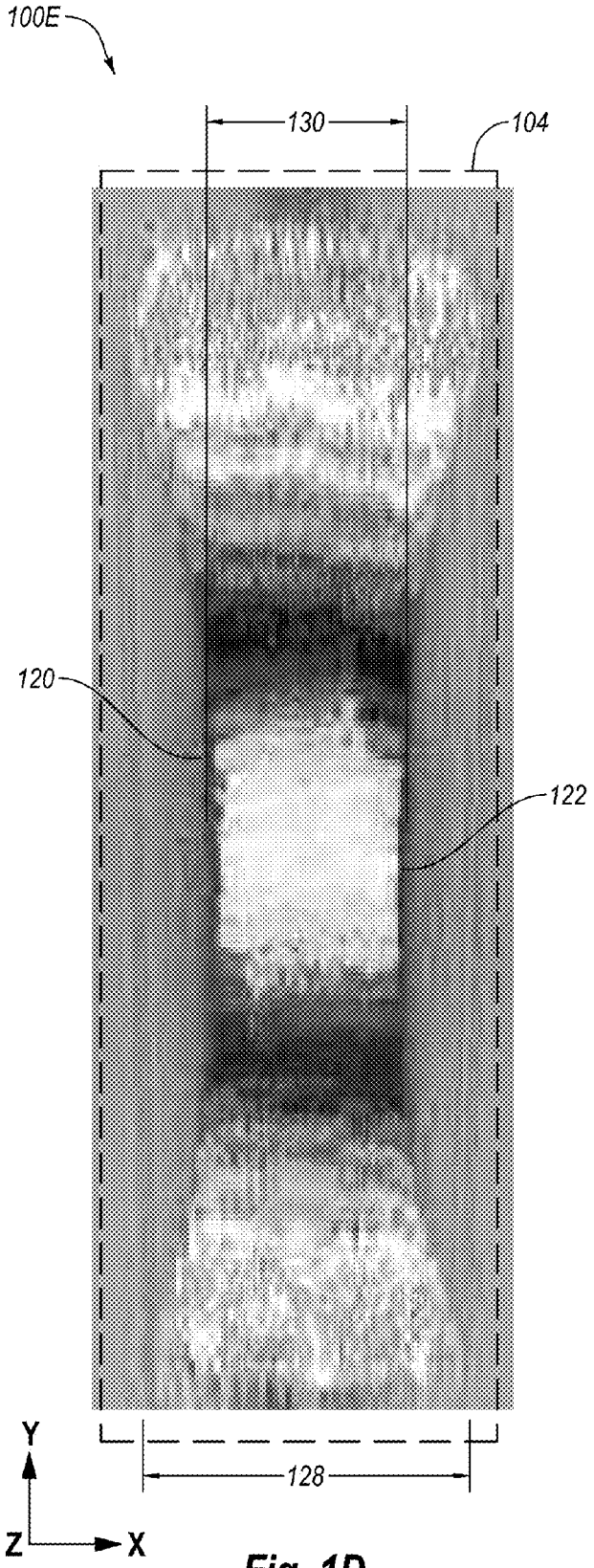
FIG. 1D illustrates another example non-rectilinear focal spot.

With reference to FIG. 1D, a fifth focal spot 100E may result from a cathode assembly implementing a focusing cup that defines a focusing aperture having a substantially rectilinear shape. The fifth focal spot 100E includes an "hourglass" shape in which a first side 120 and a second side 122 are arced with respect to the dashed box 104.

Accordingly, some embodiments described herein include focusing structures that define non-rectilinear focusing apertures. The focusing structures and in particular the focusing apertures may shape the electron profile of the electrons which may result in a focal spot that is more rectilinear and may have a smaller area when compared to the focal spots 100.

Figure 2A:
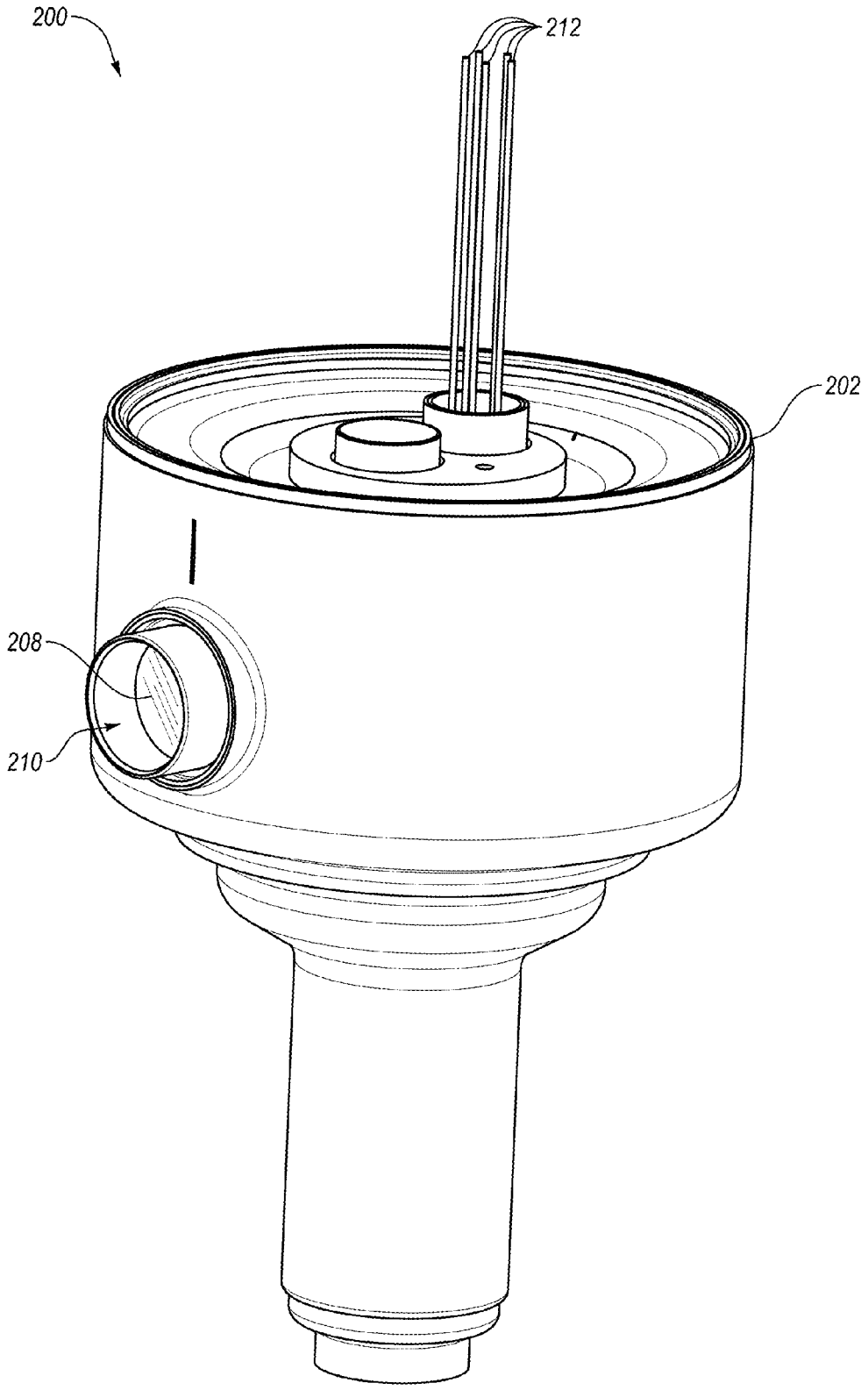
FIG. 2A illustrates an example x-ray tube.
Figure 2B:
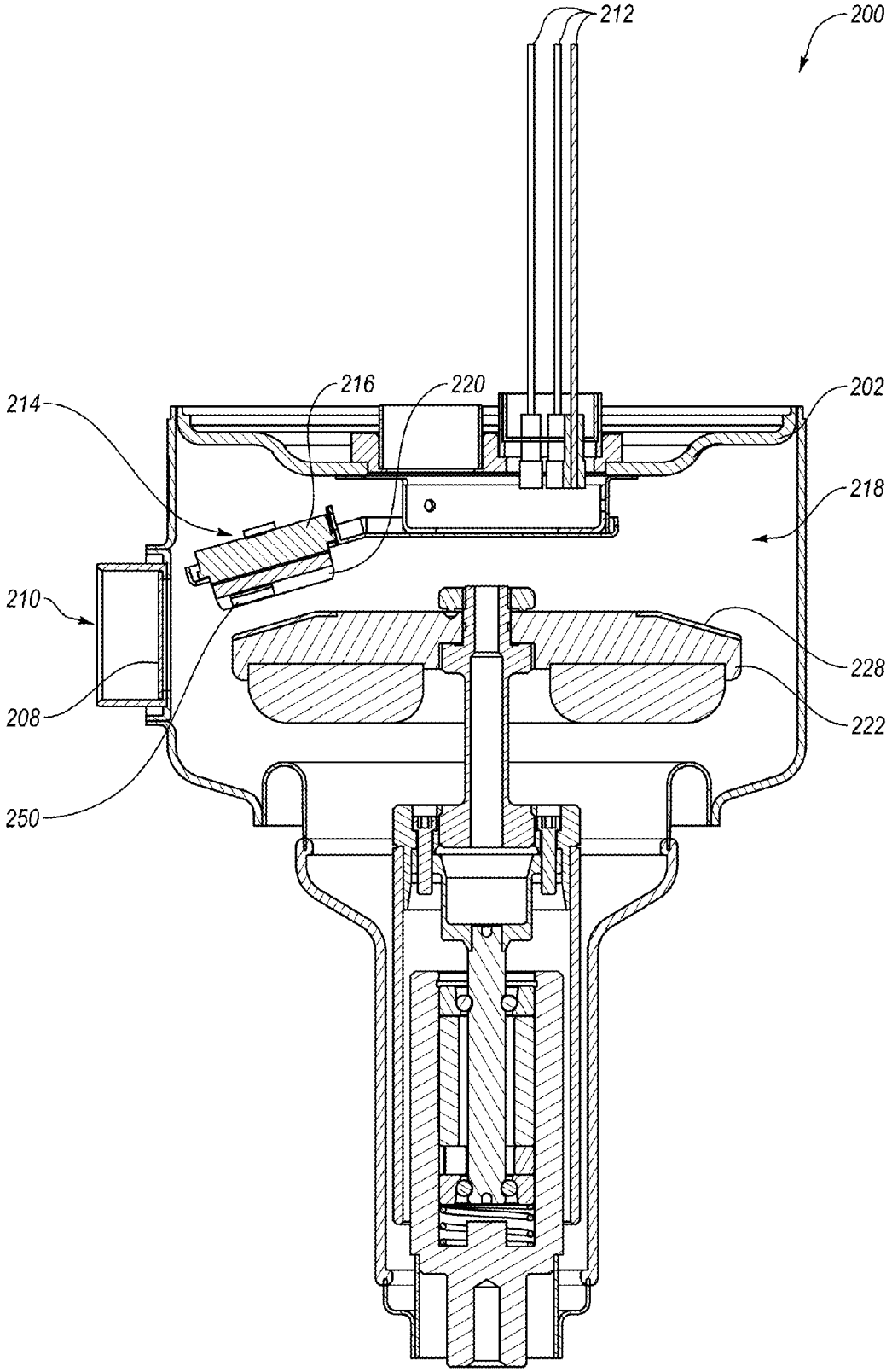
FIG. 2B illustrates another view of the x-ray tube of FIG. 2A.
Figure 2C:
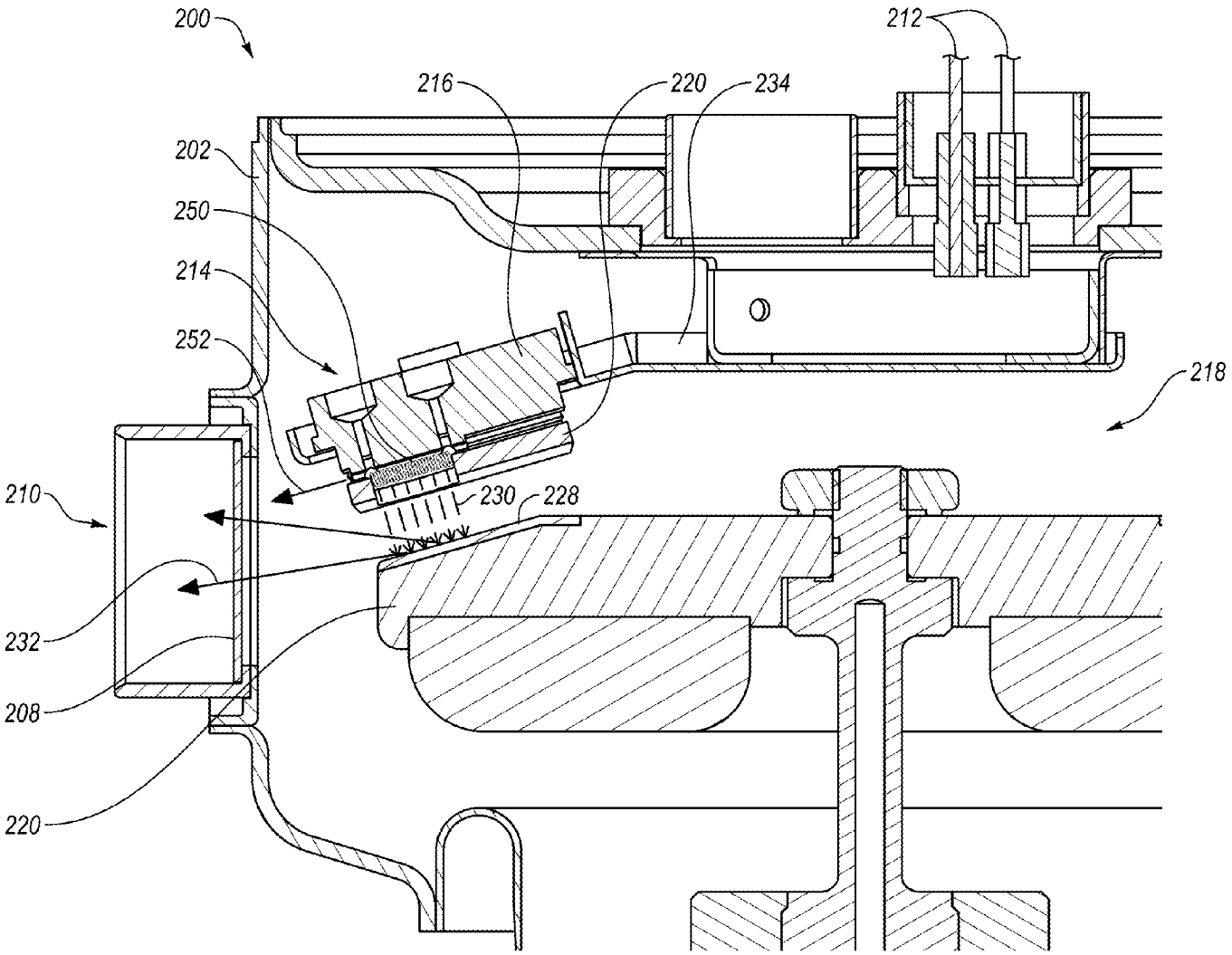
FIG. 2C illustrates another view of the x-ray tube of FIGS. 2A and 2B.

FIGS. 2A-2C illustrate an example x-ray tube 200. Specifically, FIG. 2A depicts an exterior view of the x-ray tube 200, FIG. 2B depicts a sectional view of the x-ray tube 200, and FIG. 2C depicts another sectional view of the x-ray tube 200. Generally, x-rays are generated within the x-ray tube 200, some of which then exit the x-ray tube 200 to be utilized in an application such as a medical application or an industrial application. The x-ray tube 200 may include a vacuum structure 202 which acts as the outer structure of the x-ray tube 200 and defines an evacuated volume 218 (FIGS. 2B and 2C only). One or more of the x-ray tube components (e.g., 208, 216, 214, 222, and 228) are positioned within the evacuated volume 218 as depicted in FIGS. 2B and 2C.

The x-ray tube 200 includes a window 208. The window 208 is positioned in an opening 210 defined in the vacuum structure 202. The window 208 allows some of the x-rays generated in the x-ray tube 200 to exit the x-ray tube 200. The x-rays that exit the x-ray tube 200 may be directed towards a detector such as a digital detector or photographic film. The window 208 may be composed of beryllium or another suitable material.

The x-ray tube 200 may include one or more electrical conductors 212. The electrical conductors 212 are configured to transfer electrical energy into the vacuum structure 202 and to a cathode assembly 214 (FIGS. 2B and 2C only).

With reference to FIGS. 2B and 2C, the cathode assembly 214 includes a cathode head 216 that is configured to retain one or more filaments 250 and a focusing structure such as a cathode head insert 220. The filaments 250 are configured to receive the electrical energy transferred from the electrical conductors 212 and to emit electrons by thermionic emission. The electrons are emitted past the cathode head insert 220 and into the evacuated volume 218.

A rotating anode 222 is positioned within the evacuated volume 218 of the x-ray tube 200. The rotating anode 222 may rotate about an axis substantially parallel to the z-axis in an arbitrarily defined coordinate system of FIGS. 2A-2C. The rotating anode 222 is spaced apart from and positioned opposite the cathode assembly 214. The electrons emitted from the cathode assembly 214 impinge upon a target surface 228 of the rotating anode 222. The target surface 228 is oriented with respect to the window 208 such that the x-rays generated from such impingement are directed towards the window 208. At least some portion of the x-rays then exits the x-ray tube 200 via the window 208.

The rotating anode 222 is configured to rotate as an electron beam is emitted from the cathode assembly 214. Accordingly, the target surface 228 is shaped as a ring around the rotating anode 222. The location in which the electron beam impinges on the target surface 228 is referred to herein as a focal spot (not shown in FIGS. 2A-2C). While in embodiments including the rotating anode 222, the focal spot may include a ring formed on the target surface 228, focal spots are generally discussed herein as if the rotating anode 222 is stationary. Some additional details of the focal spot are discussed elsewhere herein.

The rotating anode 222 may be at least partially composed of a thermally conductive material. For example, the conductive material may include tungsten or molybdenum alloy. The target surface 228 may be composed of tungsten or a similar material having a high atomic ("high Z") number. A material with a high atomic number may be used for the target surface 228 so that the material correspondingly includes electrons in "high" electron shells that may interact with the electron beam to generate x-rays.

With reference to FIG. 2C, during operation of the x-ray tube 200, the rotating anode 222 and the filaments 250 are connected in an electrical circuit. The electrical circuit allows the application of a high voltage potential between the rotating anode 222 and the filaments 250. Additionally, the filaments 250 are connected to a power source via the electrical conductors 212 such that an electrical current can be passed through the filaments 250 to cause an electron beam 230 to be emitted by thermionic emission. The application of a high voltage differential between the rotating anode 222 and the filaments 250 cause the electron beam 230 to propagate through the evacuated volume 218 towards the target surface 228. As the electron beam 230 propagates, the electron beam 230 gains kinetic energy. Upon striking the target surface 228, x-rays 232 are generated.

As the electron beam 230 leaves the filaments 250, a focusing aperture shapes the emission profile of the electrons. For example a focusing aperture can be defined in the cathode head 216, which may shape the emission profile. Additionally or alternatively, the cathode head insert 220 and a focusing aperture defined therein can shape the emission profile of the electrons. The emission profile, and the evolution thereof as the electron beam propagates towards the target surface 228, at least partially determines the shape of the focal spot.

In the depicted x-ray tube 200, the filaments 250 include a helix or spiral structure that extends in a longitudinal direction. In FIG. 2C, the longitudinal direction is represented by an arrow 252.

The x-ray tube 200 of FIGS. 2A-2C includes the rotating anode 222. Some embodiments include an x-ray tube including a stationary anode. For example, in some embodiments include an x-ray tube similar to that described in U.S. Pat. No. 8,036,341, which is incorporated herein by reference in its entirety.

Additionally, the x-ray tube 200 of FIGS. 2A-2C includes the cathode assembly 214 including two filaments 250. Some embodiments include the x-ray tube 200 including a single filament. Moreover, the x-ray tube 200 of FIGS. 2A-2C includes the cathode assembly with the cathode head 216, the filaments 250, and the cathode head insert 220. In some embodiments, the x-ray tube may include a cathode head, a focusing cup, and a high voltage shield, an example of which are described in U.S. Pat. No. 8,036,341. Some additional details of an x-ray tube including a focusing cup are discussed with reference to FIG. 6.

Figure 3A:
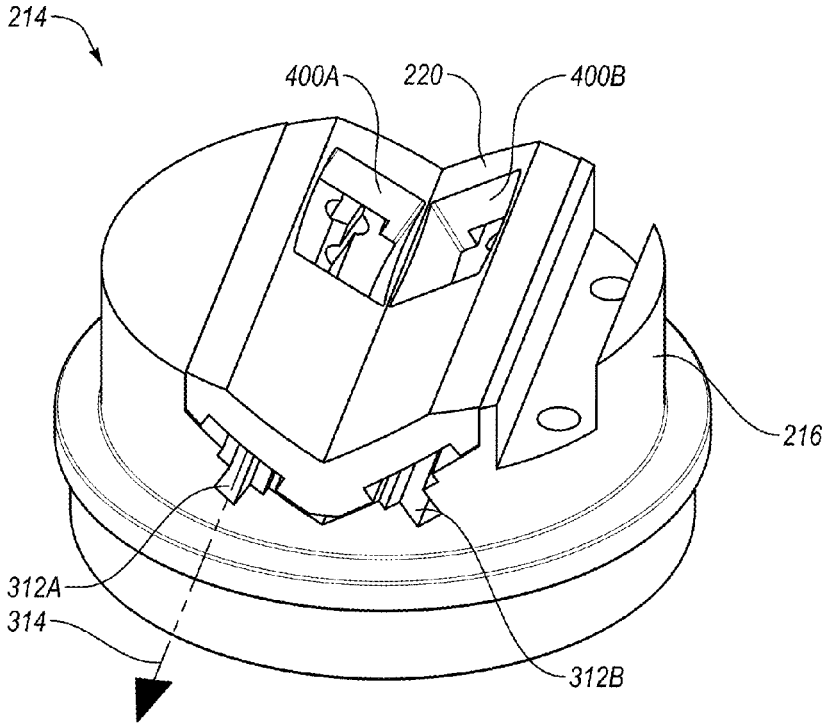
FIG. 3A illustrates an example cathode assembly that may be implemented in the x-ray tube of FIGS. 2A-2C.
Figure 3B:
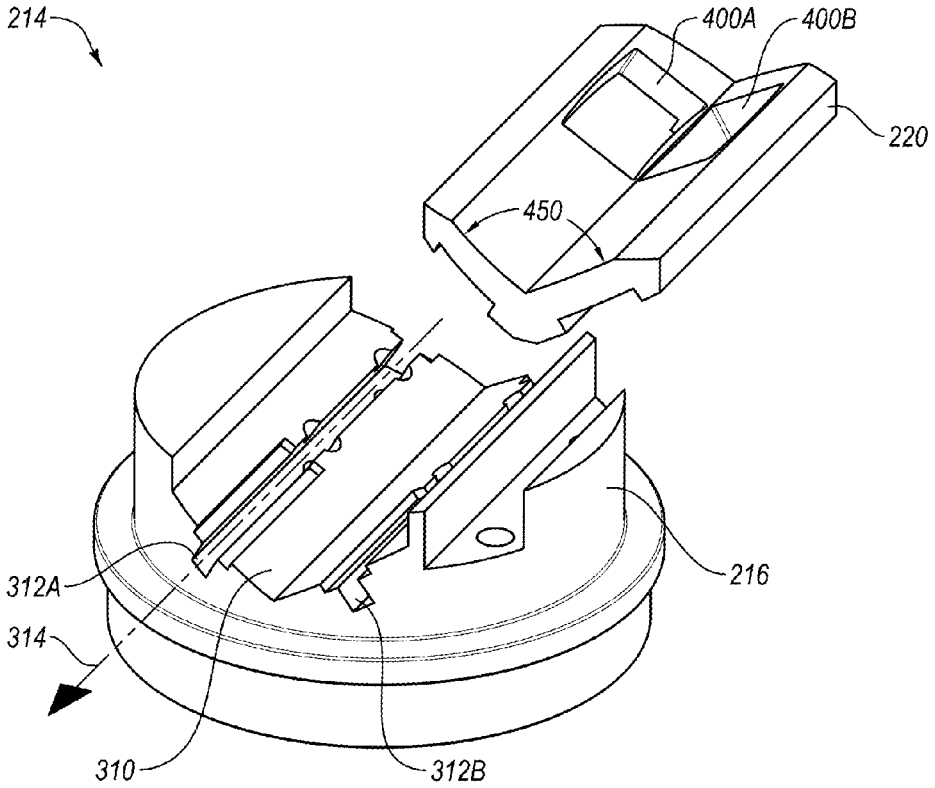
FIG. 3B illustrates another view of the cathode assembly of FIG. 3A.

FIGS. 3A and 3B illustrate an example embodiment of the cathode assembly 214. The cathode assembly 214 includes the cathode head 216 and the cathode head insert 220. The cathode head insert 220 is a type of focusing structure implemented to shape at least partially the electron beam emitted by one or more filaments (e.g., 250). With combined reference to FIGS. 2C, 3A, and 3B, the cathode head 216 may be positioned in a cathode assembly arm 234 that positions the cathode head 216 opposite the target surface 228.

Referring back to FIGS. 3A and 3B, the cathode head 216 may define an insert recess 310. The insert recess 310 is configured to receive the cathode head insert 220. For instance, in the depicted embodiment, the insert recess 310 may be substantially V-shaped to receive the cathode head insert 220 that is V-shaped. In FIG. 3A, the cathode assembly 214 is depicted with the cathode head insert 220 received in the cathode head 216. In FIG. 3B, the cathode assembly 214 is depicted with the cathode head insert 220 exploded from the cathode head 216.

As best illustrated in FIG. 3B, the cathode head 216 further defines one or more filament slots 312A and 312B (generally, filament slot 312 or filament slots 312). The filament slots 312 are configured to have a filament positioned therein. The filament slots 312 are defined substantially parallel to a first direction represented in FIGS. 3A and 3B by an arrow 314. When filaments are positioned in the filament slots 312, the longitudinal dimension of the filament is substantially parallel to and/or oriented along a first direction 314.

The cathode head insert 220 defines two non-rectilinear focusing apertures 400A and 400B (generally, focusing aperture 400 or focusing apertures 400). The focusing apertures 400 are openings defined in the cathode head insert 220 through which an electron beam is emitted. As the electron beam propagates through the focusing apertures 400, an emission profile of the electron beam is shaped.

In the cathode head 216, there are two focusing apertures 400. A first focusing aperture 400A is positioned over a first filament slot 312A. In particular, the first focusing aperture 400A is positioned over a portion of the first filament slot 312A in which a filament may be positioned. Accordingly, the filament in the first filament slot 312A emits an electron beam that propagates through the first focusing aperture 400A. The emission profile of the electron beam is shaped, at least partially, by the first focusing aperture 400A. Likewise, a second focusing aperture 400B is positioned over a portion of a second filament slot 312B in which a filament may be positioned. Thus, the filament in the second filament slot 312B emits an electron beam that propagates through the second focusing aperture 400B. The emission profile of the electron beam is shaped, at least partially, by the second focusing aperture 400B. In typical operation, an electron beam may only be emitted through the first focusing aperture 400A or the second focusing aperture 400B at any time.

Figure 4:
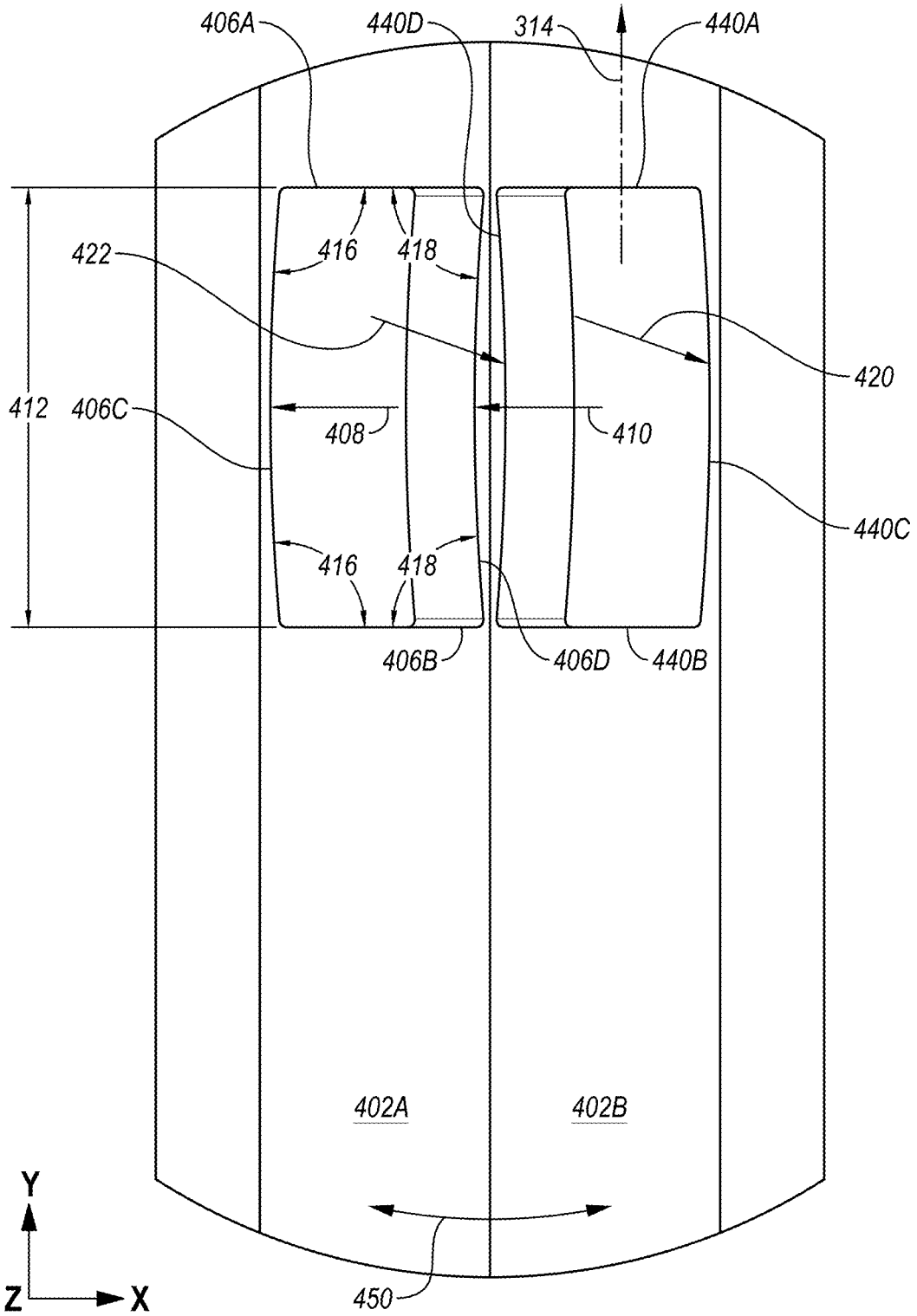
FIG. 4 illustrates an example cathode head insert that may be implemented in the cathode assembly of FIGS. 3A and 3B.

FIG. 4 illustrates an example embodiment of the cathode head insert 220. The cathode head insert 220 includes examples of the focusing apertures 400 of FIGS. 3A and 3B. The cathode head insert 220 generally includes two sloped surfaces 402A and 402B that meet at a central joint 404. In the cathode head insert 220 of FIG. 4, a first sloped surface 402A is substantially symmetric about the central joint 404 to a second sloped surface 402B. For instance, dimensions of the sloped surfaces 402A and 402B are substantially equal. Additionally, the first focusing aperture 400A defined in the first sloped surface 402A is substantially symmetric to the second focusing aperture 400B defined in the second sloped surface 402B.

The focusing apertures 400 are examples of non-rectilinear focusing apertures. Generally, a non-rectilinear focusing aperture (e.g., 400) includes at least one portion of at least one edge that is arced and/or curved. For example, the first focusing aperture 400A includes two substantially linear edges 406A and 406B and two curved edges 406C and 406D.

As used herein, the term "linear" is meant as a dissimilar characteristic to "curved." One with skill in the art, with the benefit of this disclosure may appreciate, limitations associated with manufacturing capabilities and that creating an absolutely linear feature (e.g., a radius of curvature equal to infinity) as well as two features being absolutely parallel or perpendicular may be difficult if not impossible. Accordingly, all such relational and geometric characteristics are meant herein to incorporate such manufacturing limitations as well as substantially equivalent structures.

The linear edges 406A and 406B are oriented perpendicular to the first direction 314. The curved edges 406C and 406D are generally oriented along the first direction 314. As used herein, "oriented along a direction" indicates that a linear approximation of the curved edge 406C or 406D that is substantially perpendicular to the linear edges may be parallel to the direction.

In the embodiment of FIG. 4, the curved edges 406C and 406D include curves defined according to a first set of radii of curvature. The radii of curvature are represented in FIG. 4 by arrows 408 and 410. A first set of radii of curvature 408 and 410 include substantially equivalent magnitudes and are oriented in substantially the same direction. In some embodiments, one or more of the first set of radii of curvature 408 and/or 410 are about five times an aperture length 412 defined between the linear edges 406A and 406B.

The second focusing aperture 400B may be similar to the first focusing aperture 400A. For example, in the embodiment of FIG. 4, the second focusing aperture 400B may be symmetric to the first focusing aperture 400A about the central joint 404. For example, the second focusing aperture 400 may include a first linear edge 440A, a second linear edge 440B, a first curved edge 440C, and a second curved edge 440D. The first and second curved edges 440C and 440D may be defined according to a second set of radii of curvature 422 and 420. The first set of radii of curvature 408 and 410 may have a substantially equivalent magnitude to the second set of radii of curvature 420 and 422. However, the first set of radii of curvature 408 and 410 may be oriented in a different direction from the second set of radii of curvature 420 and 422. For example, an orientation of the first set of radii of curvature 408 and 410 may differ from an orientation of the second set of radii of curvature 420 and 422 by an angle 450 (in FIGS. 4 and 3B) between the first sloped surface 402A and the second sloped surface 402B.

In the embodiment of FIG. 4, the curved edges 406C and 406D of the first focusing aperture 400A and the curved edges 440C and 440D are substantially parallel, as are the linear edges 406A and 406B and 440A and 440B. Additionally, in the first focusing aperture 400A, a first curved edge 406C meets a first linear edge 406A and a second linear edge 406B at obtuse angles 416. Additionally, a second curved edge 406D meets the first linear edge 406A and the second linear edge 406B at acute angles 418.

In some embodiments, the curved edges 406C and 406D of the first focusing aperture 400A and the curved edges 440C and 440D may not be substantially parallel. Instead, in these and other embodiments, the radii of curvature 408, 410, 420, 422 may differ in magnitude, which may affect a shape of a focal spot. Moreover, in some embodiments, the focusing apertures 400A and/or 400B may include only one curved edge, three curved edges, or four curved edges. More generally, in some embodiments, the focusing apertures 400A and/or 400B may include one or more edges, and any subset of them may be curved or linear.

The curve of the focusing apertures 400 may be oriented to compensate for a lack of rectilinear conformity of a focal spot. For example, with combined reference to FIGS. 1C and 4, the focal spots 100C and 100D may result from a cathode head insert similar to the cathode head insert 220, but that defines rectilinear focusing apertures. The curve of the focusing apertures 400 may be in a direction opposite the arced contour 110 and opposite the direction in which the spot protrusions 106 extend. For example, the curve of the second focusing aperture 400B may be in a direction opposite the arced contour 110 and the spot protrusions 106 that appear on the second side 112 of the fourth focal spot 100D.

Figure 5B:
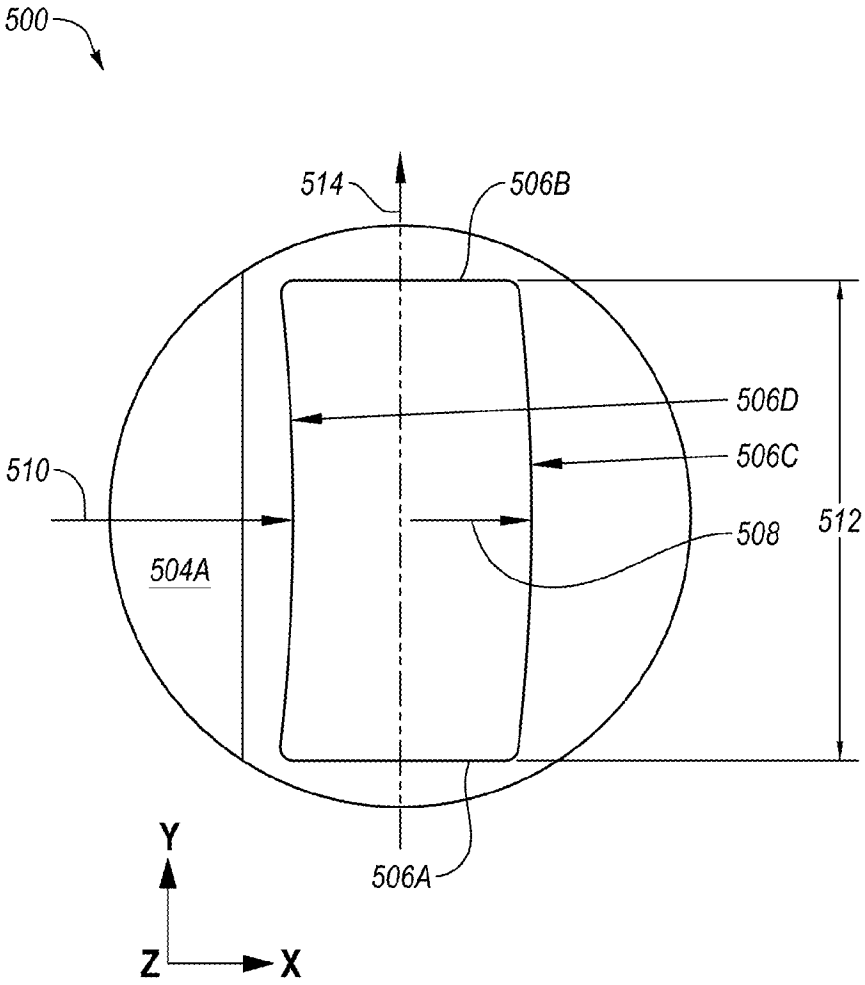
FIG. 5B illustrates another view of the cathode head insert of FIG. 5A.
Figure 5A:
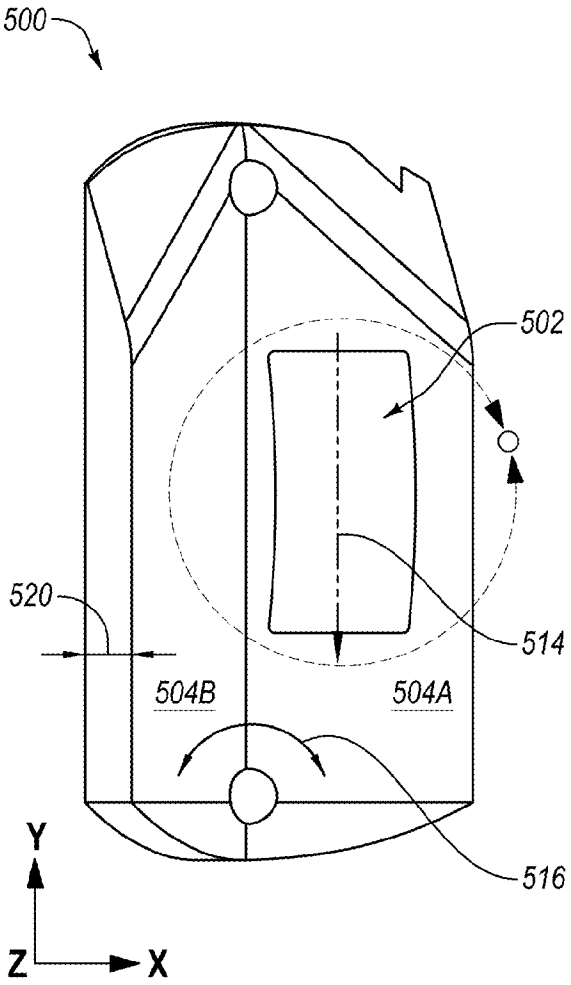
FIG. 5A illustrates another example cathode head insert that may be implemented in an x-ray tube.

FIGS. 5A and 5B illustrate another example cathode head insert 500, which is an example of a focusing structure. The cathode head insert 500 defines another example non-rectilinear focusing aperture 502. The focusing aperture 502 can be implemented to improve rectilinear conformity of a focal spot generated on an anode. For example, the focusing aperture 502 may reduce the spot protrusions (e.g., 106 of FIG. 1) and/or a general arced contour (e.g., the arced contour 110 of FIG. 1) of the focal spot.

With reference to FIG. 5A, the cathode head insert 500 includes sloped surfaces 504A and 504B. The sloped surfaces 504A and 504B may be symmetric with reference to a central joint 506 connecting the sloped surfaces 504A and 504B. The focusing aperture 502 is defined in a first sloped surface 504A. There is no focusing aperture defined in a second sloped surface 504B.

The cathode head insert 500 is configured such that it can be received in a cathode head. The cathode head may be similar to the cathode head 216 discussed herein. However, the cathode head configured to receive the cathode head insert 500 might include a single filament slot, which may be configured to have a single filament positioned therein. When the filament and the cathode head insert 500 are positioned in the cathode head, the filament may be oriented such that the longitudinal dimension of the filament is parallel to a first direction 514. An emission profile of an electron beam emitted by such filament may be shaped by the focusing aperture 502. By shaping the emission profile, the shape of a resulting focal spot may be altered.

FIG. 5B depicts a detailed view of a portion of the cathode head insert 500. The focusing aperture 502 includes two linear edges 506A and 506B and two curved edges 506C and 506D. The curved edges 506C and 506D are oriented along the first direction 514. The linear edges 506A and 506B are generally oriented perpendicular to the first direction 514.

The curved edges 506C and 506D may be curved according to radii of curvature 508 and 510, respectively. The radii of curvature 508 and 510 may be substantially equivalent, such that the curved edges 506C and 506D are parallel. For instance, the radii of curvature 508 and 510 may have substantially equivalent magnitudes and may be oriented in substantially the same direction. Alternatively, the radii of curvature 508 and 510 may differ such that at least some portion of the radii of curvature 508 and 510 are not parallel. In some embodiments, the radii of curvature 508 and 510 may be determined in relation to a length 512, an angle 516 (FIG. 5A only) of the sloped surfaces 504A and 504B, a thickness 520 (FIG. 5A only), a distance between the cathode head insert 500 and an anode, other factors, or any combination thereof. For example, in some embodiments, the length 512 is about 0.366 centimeters (cm), the thickness 520 is about 0.106 cm, the angle 516 is about 120 degrees, and the radii of curvature 508 and 510 are about 1.685 cm.

The focusing aperture 502 includes a general curved profile. The curved profile of the focusing aperture 502 may be oriented and/or shaped to compensate for a lack of rectilinear conformity of a focal spot. For example, with combined reference to FIGS. 1A and 5B, the first focal spot 100A may result from a cathode head insert similar to the cathode head insert 500, but having a rectilinear focusing aperture. The curved profile of the focusing aperture 502 may be oriented in a direction opposite the arced contour 110 and the spot protrusions 106 that appear on the first side 108 of the first focal spot 100A. In particular, the spot protrusions 106 of the first focal spot extend in a positive x-direction. In contrast, the curved profile of the focusing aperture 502 may generally curve in a negative x-direction.

Figure 6:
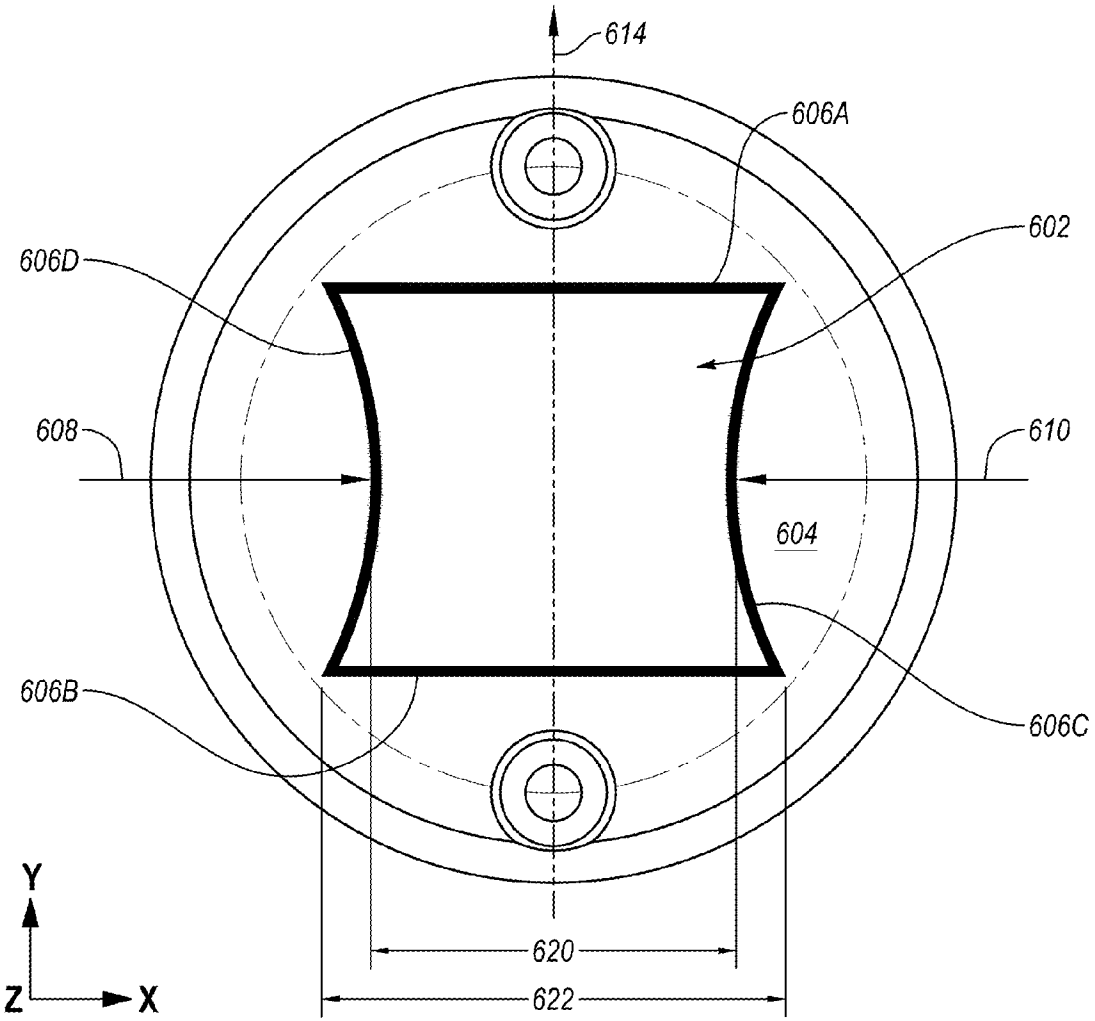
FIG. 6 illustrates an example focusing cup that may be implemented in an x-ray tube.

FIG. 6 illustrates an example focusing cup 600, which is an example of a focusing structure that may be implemented in a cathode assembly. In some embodiments, the cathode focusing cup 600 may be implemented in a stationary anode x-ray tube. An example of a stationary anode x-ray tube in which the cathode focusing cup 600 may be similar to that described in U.S. Pat. No. 8,036,341. For example, the focusing cup 600 may be implemented in the embodiment depicted in FIG. 1 of U.S. Pat. No. 8,036,341.

The focusing cup 600 defines another example non-rectilinear focusing aperture 602. The focusing aperture 602 can be implemented to improve rectilinear conformity of a focal spot generated on an anode. For example, the focusing aperture 602 may reduce rounded corners and/or an hourglass shape of the focal spot.

The cathode focusing cup 600 includes a surface 604. The focusing aperture 602 is defined in the surface 604 such that an electron beam may propagate through the surface 604. The focusing aperture 602 includes two linear edges 606A and 606B and two curved edges 606C and 606D. The curved edges 606C and 606D are generally oriented along a first direction 614. The linear edges 606A and 606B are generally oriented perpendicular to the first direction 614. The cathode focusing cup 600 is configured such that it can be positioned in relation to a cathode head. The cathode head may be similar to the cathode head 216 discussed herein. However, the cathode head configured to receive the cathode focusing cup 600 might include a single filament slot, which may be configured to have a filament positioned therein. When the filament and the cathode focusing cup 600 are positioned in the cathode head, the filament may be oriented such that the longitudinal dimension of the filament is parallel to the first direction 614. An emission profile of an electron beam emitted by such filament may be shaped by the focusing aperture 602 as the electron beam propagates though the focusing cup 600. By shaping the emission profile, the shape of a resulting focal spot may be altered.

The curved edges 606C and 606D may be curved according to radii of curvature 608 and 610, respectively. The radii of curvature 608 and 610 have substantially equivalent magnitudes and are oriented in opposite directions. For example, a first radius of curvature 608 is oriented in the positive x-direction and a second radius of curvature 610 is oriented in the negative x-direction.

Alternatively, in some embodiments, the radii of curvature 608 and 610 may have differing magnitudes. For example, the focusing aperture 602 may not be centered on the surface 604 and/or the geometries of the cathode assembly may dictate asymmetric radii of curvature 608 and 610.

The curved edges 606C and 606D are generally oriented along the first direction 614, which corresponds to the longitudinal dimension of a filament, and creates an hourglass profile. The hourglass profile of the focusing aperture 602 may be oriented and/or shaped to compensate for a lack of rectilinear conformity of a focal spot. For example, with combined reference to FIGS. 1B, 1D, and 5B, the focal spots 100B or 100E may result from a cathode head insert similar to the focusing cup 600, but having a rectilinear focusing aperture. The hourglass profile of the focusing aperture 602 may be oriented to compensate for the rounded corners 114 of FIG. 1B or the arced sides 120 and 122 of FIG. 1D. The second focal spot 100B may result from an electron beam that does not cross between the cathode assembly and the anode, for example. Thus, the second focal spot 100B includes a central width 124 that is greater than a distal width 126. Accordingly, the hourglass profile of the focusing aperture 602 includes a central width 620 that is less than a distal width 622. The fifth focal spot 100E may result from an electron beam that crosses between the cathode assembly and the anode, for example. Thus, the fifth focal spot 100E includes a central width 130 that is less than a distal width 128. Accordingly, the hourglass profile of the focusing aperture 602 includes the central width 620 that is less than the distal width 622.

The present invention may be embodied in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A cathode assembly comprising:

a cathode head that defines a filament slot and an insert recess;

a filament positioned in the filament slot that is capable of emitting electrons by thermionic emission;

a cathode head insert that is configured to be received in the insert recess and positioned at least partially between the filament and an anode, the cathode head insert including a first sloped surface connected to a second sloped surface; and a non-rectilinear focusing aperture defined in the first sloped surface of the cathode head insert, the non-rectilinear focusing aperture being configured to shape an emission profile of electrons emitted by the filament.

2. The cathode assembly of claim 1, wherein the non-rectilinear focusing aperture includes at least one curved edge that is oriented along a longitudinal dimension of the filament.

3. The cathode assembly of claim 1, wherein the non-rectilinear focusing aperture includes:

two linear edges oriented substantially perpendicular to a longitudinal dimension of the filament; and two curved edges oriented along the longitudinal dimension of the filament.

4. The cathode assembly of claim 3, wherein the two curved edges are defined according to radii of curvature that include substantially equivalent magnitudes and substantially equivalent directions.

5. The cathode assembly of claim 3, wherein the two curved edges are defined according to radii of curvature having a magnitude equal to about five times a length of the non-rectilinear focusing aperture.

6. The cathode assembly of claim 1, wherein the cathode head defines a second filament slot and the cathode assembly further comprises:

a second filament positioned within the second filament slot; and a second non-rectilinear focusing aperture defined in the second sloped surface of the cathode head insert, the second non-rectilinear focusing aperture being configured to shape an emission profile of electrons emitted by the second filament.

7. The cathode assembly of claim 6, wherein:

the non-rectilinear focusing aperture includes two linear edges oriented substantially perpendicular to a longitudinal dimension of the filament and two curved edges oriented along the longitudinal dimension of the filament;

the two curved edges of the non-rectilinear focusing aperture are defined according to a first set of radii of curvature that include substantially equivalent magnitudes and substantially equivalent directions;

the second non-rectilinear focusing aperture includes two linear edges oriented substantially perpendicular to a longitudinal dimension of the second filament and two curved edges oriented along the longitudinal dimension of the second filament;

the two curved edges of the second non-rectilinear focusing aperture are defined according to a second set of radii of curvature that include substantially equivalent magnitudes and substantially equivalent directions; and the direction of the first set of radii of curvature is different from the direction of the second set of radii of curvature.

8. The cathode assembly of claim 6, wherein:

the first sloped surface is connected to the second sloped surface at a central joint; and the second non-rectilinear focusing aperture is symmetric to the non-rectilinear focusing aperture about the central joint.

9. A focusing structure configured to compensate for a lack of rectilinear conformity of a focal spot produced on an anode by emission of electrons by a filament, the focusing structure comprising:

a first sloped surface;

a second sloped surface connected to the first sloped surface; and a non-rectilinear focusing aperture defined in the first sloped surface, the non-rectilinear focusing aperture including two linear edges configured to be oriented substantially perpendicular to a longitudinal dimension of the filament and two curved edges configured to be oriented along the longitudinal dimension of the filament.

10. The focusing structure of claim 9, wherein the non-rectilinear focusing aperture includes a curved profile in which the curved edges are substantially parallel to one another between the linear edges.

11. The focusing structure of claim 9, wherein:

the non-rectilinear focusing aperture includes an hourglass profile in which a central width is less than a distal width; and the curved edges are defined according to radii of curvature having substantially equivalent magnitudes and opposite directions.

12. The focusing structure of claim 9, wherein the curved edges are defined according to radii of curvature having a magnitude equal to about five times a length of the non-rectilinear focusing aperture.

13. The focusing structure of claim 9, wherein:

the second sloped surface is connected to the first sloped surface at a central joint, a second non-rectilinear focusing aperture is defined in the second sloped surface, the second non-rectilinear focusing aperture is configured to shape an emission profile of electrons emitted by a second filament, and the second non-rectilinear focusing aperture includes two linear edges configured to be oriented substantially perpendicular to a longitudinal dimension of the second filament and two curved edges configured to be oriented along the longitudinal dimension of the second filament.

14. The focusing structure of claim 13, wherein:

the non-rectilinear focusing aperture includes a first curved profile;

the second non-rectilinear focusing aperture includes a second curved profile; and the first curved profile is substantially symmetric to the second curved profile about the central joint.

15. An x-ray tube comprising:

a cathode head having a filament slot defined therein in a first direction and that defines an insert recess;

a filament capable of emitting electrons that is positioned within the filament slot such that a longitudinal dimension of the filament is oriented parallel to the first direction;

an anode including a target surface on which a focal spot is produced due to impingement of electrons emitted from a filament;

a cathode head insert that is configured to be received in the insert recess such that the cathode head insert is positioned at least partially between the filament and the anode, the cathode head insert including two sloped surfaces connected by a central joint; and a non-rectilinear focusing aperture defined in a first of the sloped surfaces, the non-rectilinear focusing aperture including at least one curved edge.

16. The x-ray tube of claim 15, wherein the non-rectilinear focusing aperture includes two linear edges configured to be oriented substantially perpendicular to the longitudinal dimension of the filament and two curved edges configured to be oriented along the longitudinal dimension of the filament.

17. The x-ray tube of claim 15, further comprising a second filament and a second non-rectilinear focusing aperture defined in a second of the sloped surfaces.

18. The x-ray tube of claim 17, wherein:

the second non-rectilinear focusing aperture is symmetric to the non-rectilinear focusing aperture about the central joint; and the second non-rectilinear focusing aperture is configured to shape an emission profile of electrons emitted by the second filament.

19. The x-ray tube of claim 15, wherein the anode is a rotating anode.

* * * * *